US008297216B1

(12) United States Patent
Janton

(10) Patent No.: US 8,297,216 B1
(45) Date of Patent: Oct. 30, 2012

(54) FOREVER FLYER FLAG AND FLAGPOLE

(76) Inventor: Walter M. Janton, Bellmawr, NJ (US)

( * ) Notice: Subject to any disclaimer, the term of this patent is extended or adjusted under 35 U.S.C. 154(b) by 268 days.

(21) Appl. No.: 12/774,344

(22) Filed: May 5, 2010

(51) Int. Cl.
*G09F 17/00* (2006.01)

(52) U.S. Cl. ..... 116/173; 116/174

(58) Field of Classification Search ..... 116/173–174; 212/281; 248/329, 334.1, 333, 218.4; 52/111, 52/123.1
See application file for complete search history.

(56) References Cited

U.S. PATENT DOCUMENTS 1,306,915 A * 6/1919 Klamroth ..... 116/174
1,645,645 A * 10/1927 Davis ..... 116/173
1,828,892 A * 10/1931 Felton ..... 116/173
2,368,783 A 2/1945 Schillinger
3,595,202 A * 7/1971 Visitacion ..... 116/174
3,680,526 A * 8/1972 Buffington, Jr. ..... 116/174
3,923,001 A * 12/1975 Murdock ..... 116/173
3,976,283 A * 8/1976 Schmit ..... 254/387
4,791,878 A * 12/1988 Lewis ..... 116/173
5,168,828 A * 12/1992 Smyly, Sr. ..... 116/173
5,291,849 A 3/1994 Zeitler
5,402,746 A 4/1995 Deschamps
5,454,202 A * 10/1995 van der Weijden ..... 40/606.09
6,758,159 B2 * 7/2004 McCudden et al. ..... 116/173
6,923,141 B1 8/2005 Staats et al.
D533,111 S 12/2006 Taddia
7,530,325 B2 * 5/2009 Swenson et al. ..... 116/173
8,109,225 B2 * 2/2012 McCudden et al. ..... 116/173
2006/0260532 A1 11/2006 Hlavin

* cited by examiner

*Primary Examiner* — R. A. Smith
*Assistant Examiner* — Tania Courson
(74) *Attorney, Agent, or Firm* — Kyle Fletcher

(57) ABSTRACT

The forever flyer flag and flagpole supports a flag in an unfurled position via a spring-loaded support arm that fully extends the top, side of a flag via a support arm pocket. The spring-loaded support arm is connected to a flag tube lift that rises up and down upon the flagpole via a rope that runs within the flagpole via a pulley. The side of the flag nearest the flagpole is fully extended via flag attachment grommets that are based upon the flag tube lift. The flag and flag tube lift can rotate about the flagpole irrespective of the flag height.

17 Claims, 6 Drawing Sheets

FOREVER FLYER FLAG AND FLAGPOLE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of flagpoles, more specifically, a flagpole that ensures that the flag is fully extended radially with respect to the flagpole.

B. Discussion of the Prior Art

As a preliminary note, it should be stated that there is an ample amount of prior art that deals with flagpole apparatuses. As will be discussed immediately below, no prior art discloses a flagpole that enables a flag to be fully extended via a spring-loaded support arm, and of which the entire flag and support system is raised upon the flagpole via a flag tube lift that is connected to a rope that traverses within the flagpole via a pulley, and wherein the flag tube lift supports a left side of the flag via flag attachment grommets, and wherein a top portion of the flag is extended upon the support arm via a support arm pocket.

The Hlavin Patent Application Publication (U.S. Pub. No. 2006/0260532) discloses a mast for a flag having a horizontal supporting wire for holding the flag in an open orientation. However, the horizontal supporting wire is not attached onto a flag tube lift that can be raised up or down upon the flagpole and of which further includes a spring-loaded support arm to maintain an extended flag while upon the flagpole.

The Deschamps Patent (U.S. Pat. No. 5,402,746) discloses a flagstaff having an upper support boom for keeping the flag unfurled in the absence of wind. However, the flagstaff does not have a flag tube lift from which the flag is supported and of which can ascend and descend on the flagpole.

The Staats et al. Patent (U.S. Pat. No. 6,923,141) discloses a flag support assembly having a plurality of brackets that are connected to the top of the flag. However, the flag support assembly employs the use of a support shaft that attaches diagonally between the flagpole and the elongated arm.

The Schillinger Patent (U.S. Pat. No. 2,368,783) discloses a flag supporting device having a horizontal rod keeping the flag in an unfurled orientation. However, the device does not include a flag tube lift that raises and lowers itself with respect to the flagpole via a rope that traverses within the flagpole via a pulley.

The Zeitler Patent (U.S. Pat. No. 5,291,849) discloses a furl preventing support assembly for a flag having an adjustable length support for accommodating flags of different sizes. However, the support assembly does not use a spring-loaded support member or include a means by which to raise and lower the flag thereon.

The Taddia Patent (U.S. Pat. No. Des. 533,111) illustrates an ornamental design for a flag support stand, which does not depict a flag tube lift to raise and support the flag thereon.

While the above-described devices fulfill their respective and particular objects and requirements, they do not describe a flagpole that enables a flag to be fully extended via a spring-loaded support arm, and of which the entire flag and support system is raised upon the flagpole via a flag tube lift that is connected to a rope that traverses within the flagpole via a pulley, and wherein the flag tube lift supports a left side of the flag via flag attachment grommets, and wherein a top portion of the flag is extended upon the support arm via a support arm pocket. In this regard, the forever flyer flag and flagpole departs from the conventional concepts and designs of the prior art.

SUMMARY OF THE INVENTION

The forever flyer flag and flagpole supports a flag in an unfurled position via a spring-loaded support arm that fully extends the top, side of a flag via a support arm pocket. The spring-loaded support arm is connected to a flag tube lift that rises up and down upon the flagpole via a rope that runs within the flagpole via a pulley. The side of the flag nearest the flagpole is fully extended via flag attachment grommets that are based upon the flag tube lift. The flag and flag tube lift can rotate about the flagpole irrespective of the flag height.

It is an object of the invention to provide a flag and flagpole system that supports a flag in an unfurled position regardless of the presence of wind.

A further object of the invention is to provide a flag and flagpole system that fully extends the flag along a top most side of the flag.

A further object of the invention is to provide a flag with a support arm pocket that works in concert with the spring-loaded support arm to ensure that the top most side of the flag is fully extended.

A further object of the invention is to provide a support arm pocket that is either integrated into the design of the flag or is simply attached onto an existing flag.

A further object of the invention is to provide a plurality of flag attachment grommets that support and fully extend the flag along a side nearest, the flagpole, and wherein said grommets are based upon the flag tube lift.

A further object of the invention is to provide a flag tube lift that can rise or descend upon the flagpole to fly or remove a flag thereon, respectively.

A further object of the invention is to enable a flag that can rotate about the flagpole irrespective of the flag pole.

These together with additional objects, features and advantages of the forever flyer flag and flagpole will be readily apparent to those of ordinary skill in the art upon reading the following detailed description of presently preferred, but nonetheless illustrative, embodiments of the forever flyer flag and flagpole when taken in conjunction with the accompanying drawings.

In this respect, before explaining the current embodiments of the forever flyer flag and flagpole in detail, it is to be understood that the forever flyer flag and flagpole is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the forever flyer flag and flagpole.

It is therefore important that the claims be regarded as including such equivalent construction insofar as they do not depart from the spirit and scope of the forever flyer flag and flagpole. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
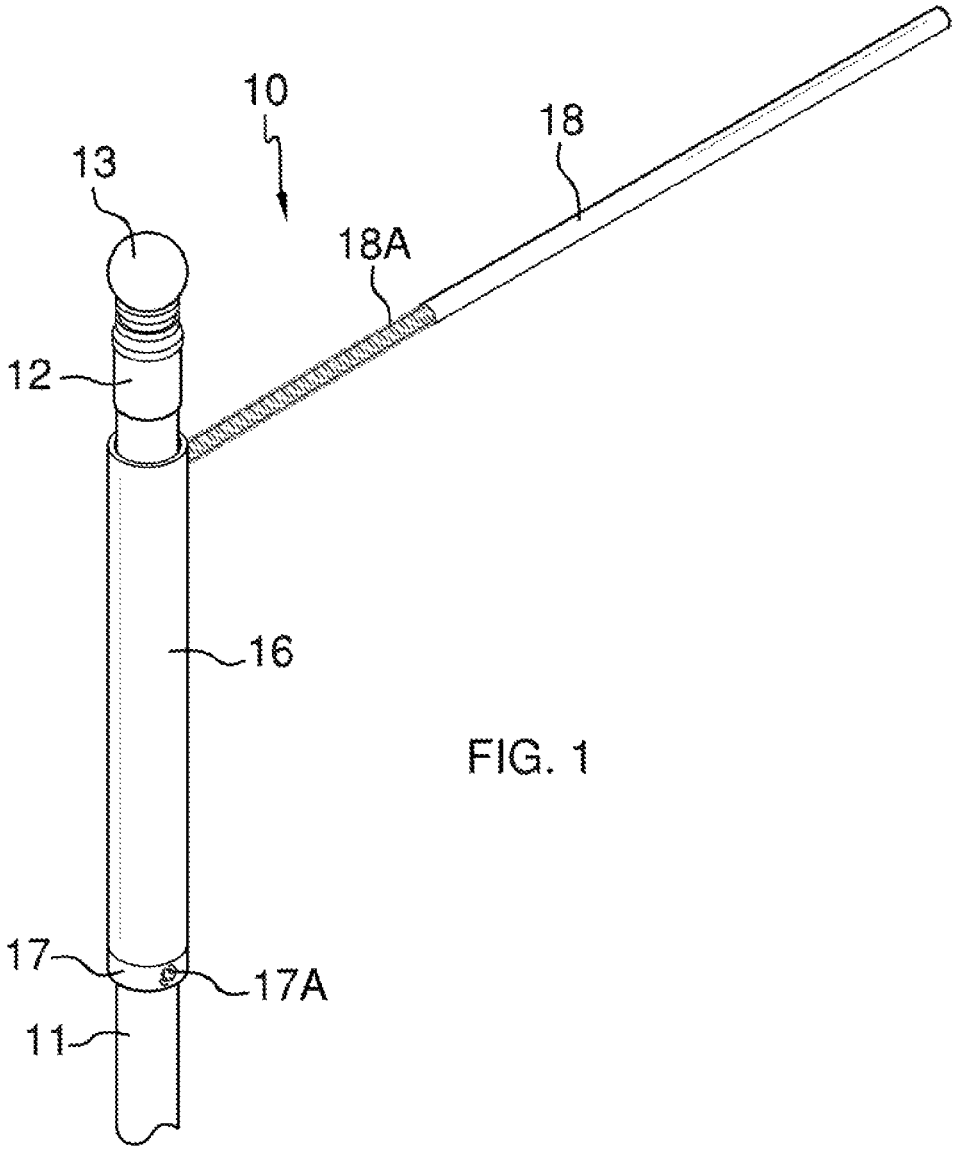
FIG. 1 illustrates a front, isometric view of the forever flyer flag and flagpole by itself with the spring-loaded support arm fully extended as well as the flag tube raised to a top most position on the flagpole.
Figure 2:
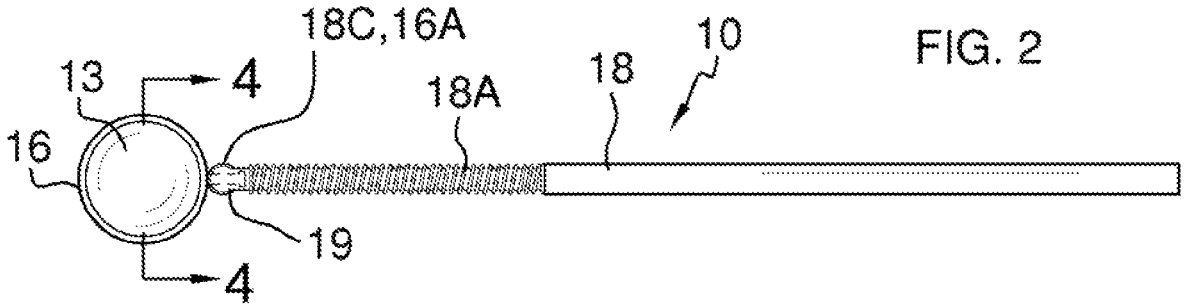
FIG. 2 illustrates a top view of the forever flyer flag and flagpole by itself with the spring-loaded support arm fully extended.
Figure 3:
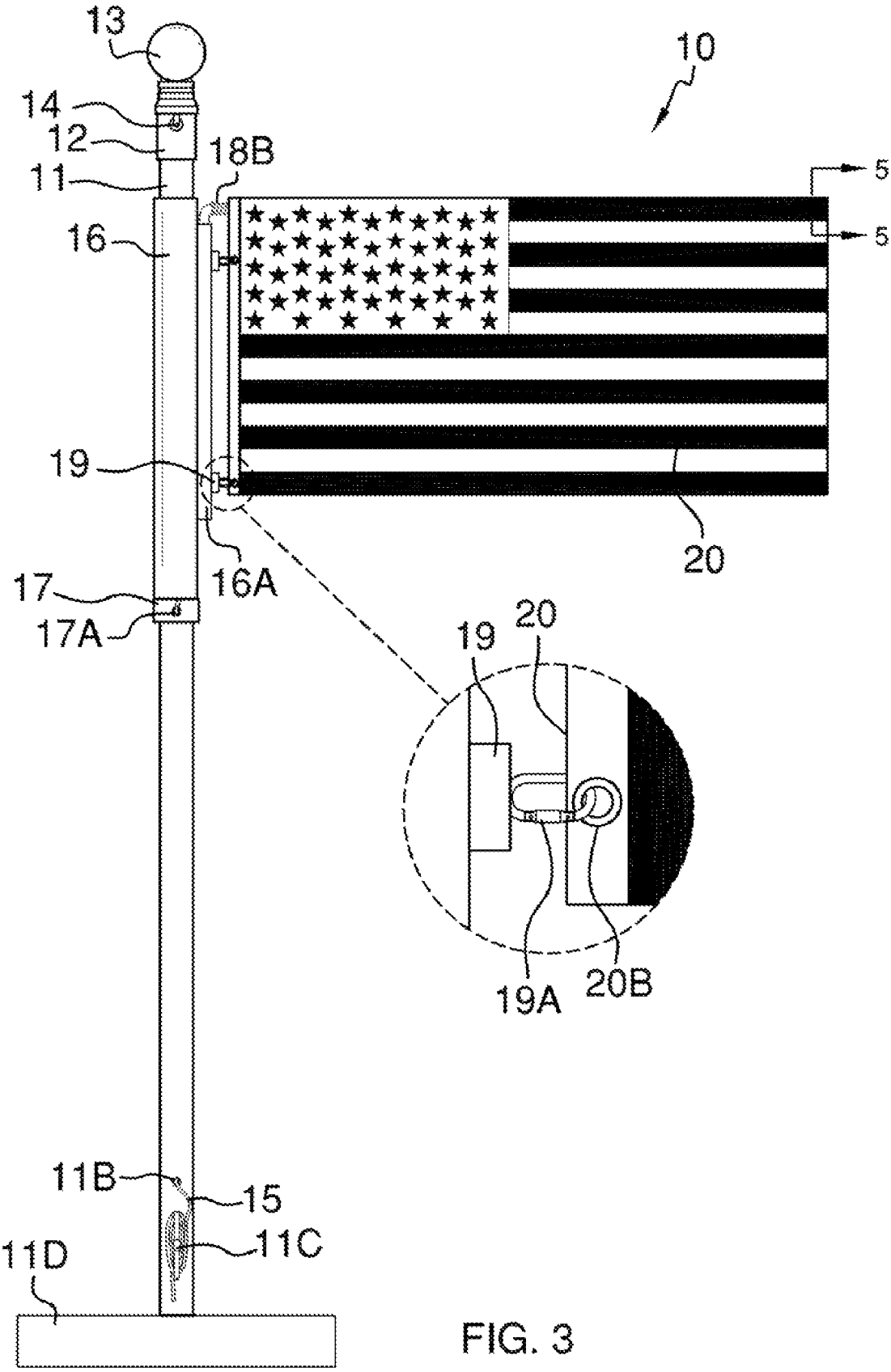
FIG. 3 illustrates a front view of the forever flyer flag and flagpole with the flag tube raised to a top most position n the flagpole and with a flag placed upon the spring-loaded support arm.
Figure 4:
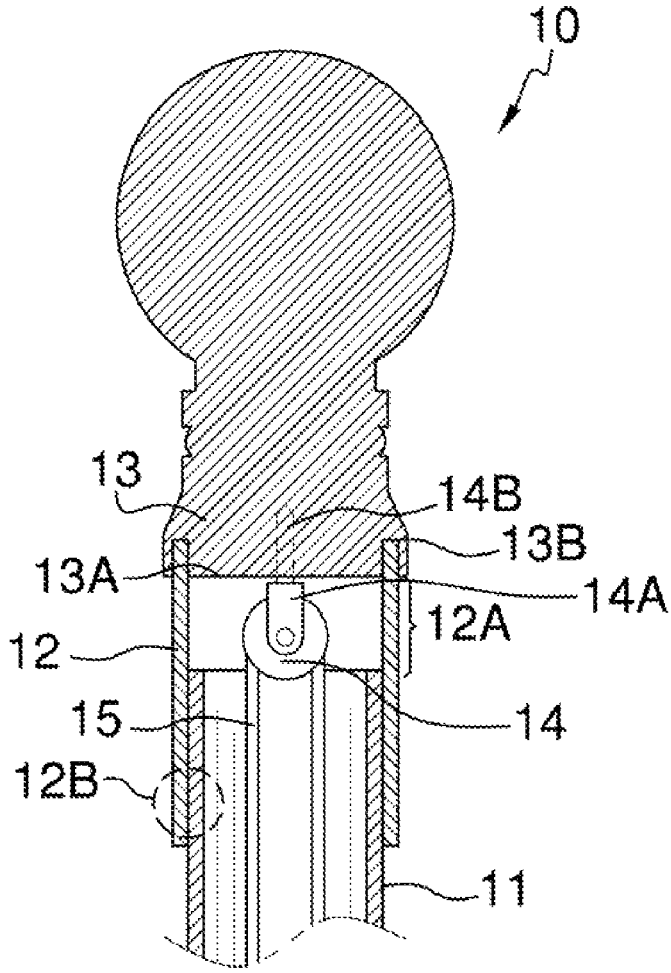
FIG. 4 illustrates a cross-sectional view of the forever flyer flag and flagpole along line 4-4 in FIG. 2 and further detailing the halyard pulley and rope contained within the flagpole.
Figure 5:
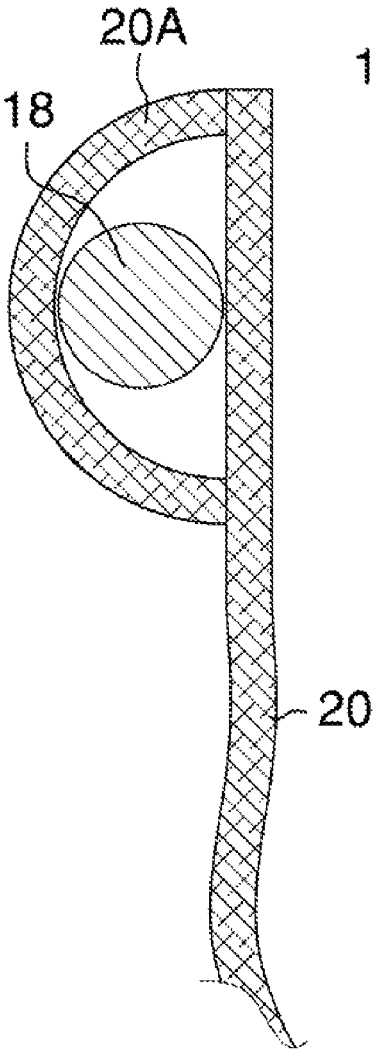
FIG. 5 illustrates a cross-sectional view of the forever flyer flag and flagpole along line 5-5 in FIG. 3 and detailing the spring-loaded support arm in spatial relationship with the support arm pocket and flag contained thereon.
Figure 6:
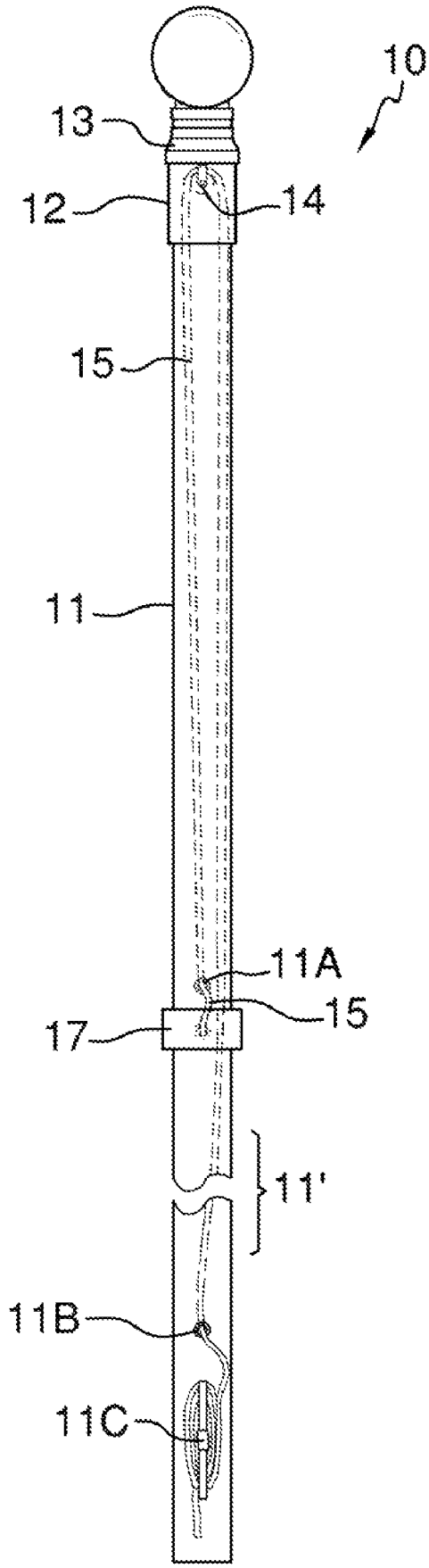
FIG. 6 illustrates a front view of the flagpole and bottom collar with hidden lines depicting the rope contained within the flag pole and with the rope being connected to the flag tube lift.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-8. A forever flyer flag and flagpole 10 (hereinafter invention) includes a flagpole 11, a flagpole extension 12, a cap 13, a pulley 14, a rope 15, a flag tube lift 16, a bottom collar 17, a spring-loaded support arm 18, flag attachment grommets 19, a flag 20.

The flagpole 11 is of hollow construction of undetermined length 11' (see the broken lines in FIGS. 6 and 7), or a length that is standard of flagpoles. The flagpole 11 is made of a material comprising a metal, carbon fiber composite, wood, or plastic.

Figure 7:
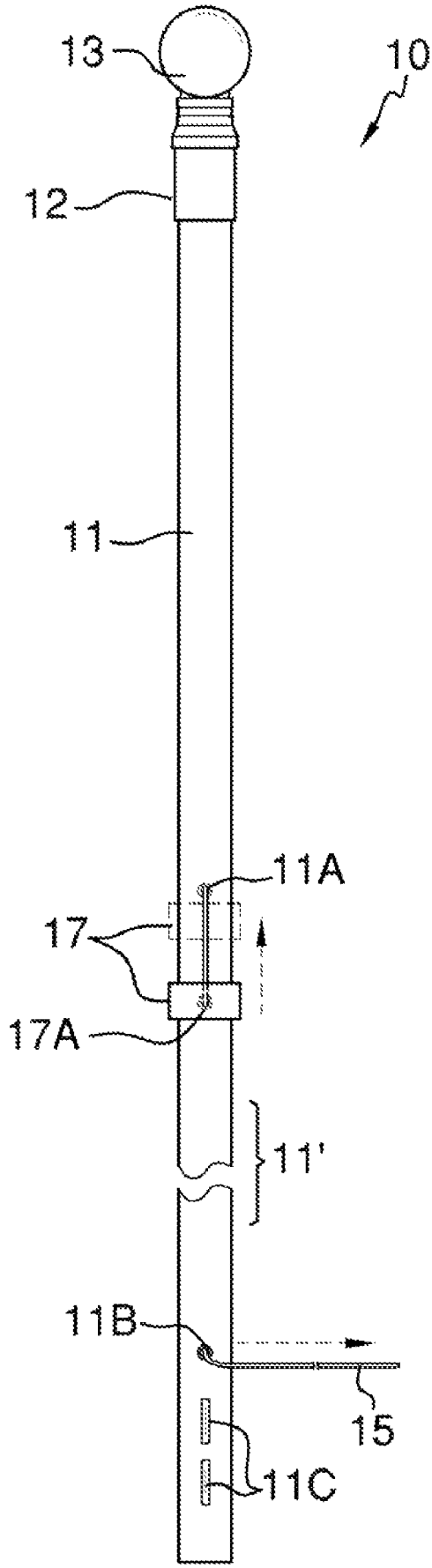
FIG. 7 illustrates a front view of the flagpole and bottom collar with arrows indicating vertically movement of the flag tube lift and horizontal movement of the rope, respectively.
Figure 8:
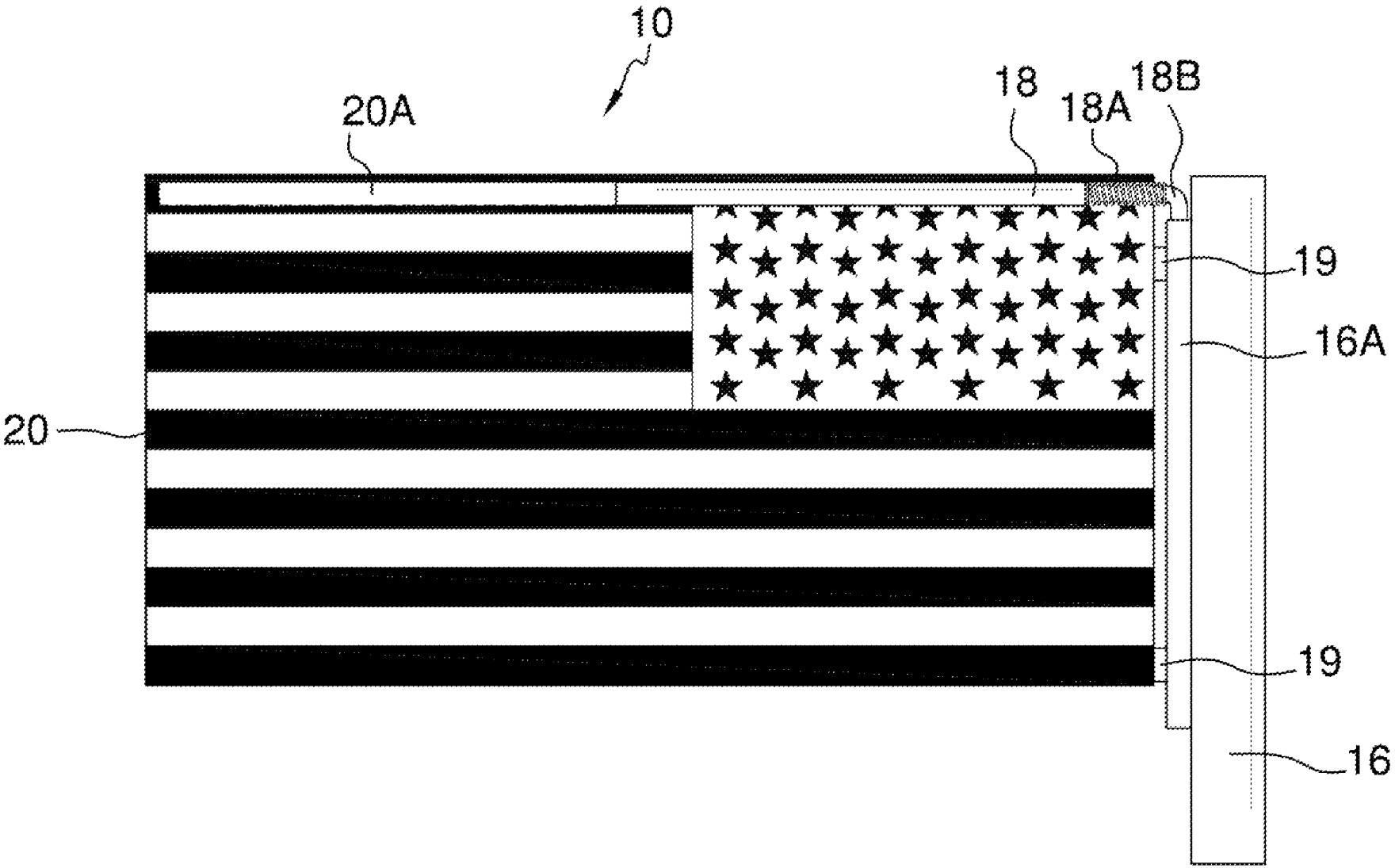
FIG. 8 illustrates a detailed view of the flag tube lift with a flag attached thereon, and further detailing the support arm pocket as depicted in hidden lines upon the flag along with the flag attachment grommets located on the flag tube.

The flagpole 11 has a top rope exit 11A, a bottom rope exit 11B, a cleat 11C, and a base 11D. The bottom rope exit 11B and the top rope exit 11A enable the rope 15 to traverse through the flagpole 11, around the pulley 14, attach on one end to the bottom collar 17, and tie in place to the cleat 11C. The top rope exit 11A limits the height that the bottom collar 17 can arise with respect to the flagpole 11, and in effect limits the height of the flag tube lift 16 and the flag 20. Referring to FIG. 7, as the rope 15 extends outwardly from the flagpole 11, the bottom collar 17 arises to a stopping position adjacent the top rope exit 11A. The opposite occurs as the rope 15 enters the flagpole 11.

The flagpole 11 includes a base 11D to support the flagpole 11 in a vertical position. However, the flagpole 11 may be vertically upright by partially burying the flagpole 11 in the ground.

The flagpole extension 12 is of hollow construction of an undefined length. The flagpole extension 12 and the cap 13 are made of a material comprising a metal, plastic, wood, or carbon fiber composite. The flagpole extension 12 is situated below the cap 13 and atop the flagpole 11. The flagpole extension 12 fits atop the flagpole 11 by having an internal diameter 12B of the flagpole extension 12 that is equal to or slightly less than (in order to produce friction) than the outer diameter of the flagpole 11. The cap 13 rests atop the flagpole extension 12 via a groove 13B that coincides with the cross-section of the flagpole extension 12. The flagpole extension 12 forms an enlarged space 12A for the pulley 14 to operate.

The pulley 14 has a main body 14A that attaches to a bottom surface 13A of the cap 13 via a securing means 14B. The securing means 14B comprises a rivet, screw, bolt, or nail. The securing means 14B must be of sufficient strength to withstand the tensile forces associated with pulling upon the rope 15 in order to rise and lower the flag 20 and flag tube lift 16.

The bottom collar 17 has a rope attachment hole 17A that enables the rope 15 to be secured at a first end to the bottom collar 17. The bottom collar 17 raises and lowers itself with respect to the flagpole 11 via the rope attachment hole 17A, the rope 15, and the top rope exit 11A.

The bottom collar 17 is a ring or made of a hollowed tubular construction that is responsible for raising and lowering the flag tube lift 16. The bottom collar 17 has an internal diameter that is slightly larger than the external diameter of the flagpole 11. The bottom collar 17 is made of a material comprising a metal, plastic, wood, or carbon fiber composite.

The spring-loaded support arm 18 has a spring 18A, a 90-degree bend 18B, and a vertical portion 18C that runs within flag tube vertical piece 16A. The spring-loaded support arm 18 is secured to the flag tube vertical piece 16A such that the spring-loaded support arm 18 and flag 20 do not become disconnected with the invention 10. The spring-loaded support arm 18 is made of a material comprising a plastic, metal, or carbon fiber composite. The spring 18A enables the spring-loaded support arm 18 to flex while ensuring that the spring-loaded support arm 18 does not break at or near the location of the 90-degree bend 18B.

The flag attachment grommets 19 are based upon the flag tube vertical piece 16A and secure and fully extend the flag 20 along a side of the flag 20 closest the flagpole 11. The flag attachment grommets 19 secure the flag 20 in place via a locking clip 19A that clips onto a flag loop hole 20B. The flag loop-hole 20B are typically associated with flags.

The flap 20 has a support arm pocket 20A, which runs along an outermost half of a top edge of the flag 20. The support arm pocket 20A secures the spring-loaded support arm 18 onto the flag 20 as well as to fully extend the flag 20 along the top, side of the flag 20. The support arm pocket 20A is either integrated into the design of the flag 20 at the time of manufacture, or is an after market accessory that is attached onto an existing flag in order to form the pocket. The support arm pocket 20A is attached via fastening means comprising stitching and/or adhesive.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A forever flyer flag and flagpole system comprising:

a flagpole on which a flag tube lift that encircles said flagpole, and which raises and lowers thereon via a rope attached to a bottom collar;

wherein the flag tube lift includes a spring-loaded support arm that extends outwardly with respect to said flagpole, and supports a flag in an unfurled condition along a top side of said flag and a side of said flag closest said flagpole;

wherein the rope traverses within the flagpole via a pulley;

wherein a cleat enables said rope to be secured to the flagpole so as to hold the flag tube lift at a predetermined elevation;

wherein the flagpole has a top rope exit that limits the height of travel of the flag tube lift;

wherein a bottom collar attaches to a first end of the rope and abuts the bottom surface of the flag tube lift to lift an lower the flag tube lift with respect to the flagpole;

wherein the bottom collar and the flag tube lift are of hollowed construction, having an internal diameter greater than the external diameter of the flagpole such that both the bottom collar and the flag lift tube encircle a portion of the flag pole;

wherein the rope connects to the bottom collar along an inner surface so as not to interfere with the flag tube lift resting atop of the bottom collar;

wherein the flag is fully extended along a top side and along a side closest the flagpole, which in effect provides an unfurled flag; and wherein the flag and the flag tube lift can rotate around the flagpole without respect to elevation upon said flagpole.

2. The forever flyer flag and flagpole as described in claim 1 wherein the flagpole is of hollowed construction of a material comprising a metal, plastic, wood, or carbon fiber composite.

3. The forever flyer flag and flagpole as described in claim 1 wherein the bottom collar and the flag tube lift are made of a material comprising a metal, plastic, wood, or carbon fiber composite.

4. The forever flyer flag and flagpole as described in claim 1 wherein the pulley attaches to a bottom surface of a cap that rests atop a flagpole extension; wherein the flagpole extension rests atop said flagpole; wherein the flagpole extension forms a space between the cap and the flagpole; and wherein the pulley attaches to the bottom surface of the cap via a securing means comprising a rivet, nail, bolt, or screen.

5. The forever flyer flag and flagpole as described in claim 4 wherein the cap and the flagpole extension are made of a material comprising a wood, metal, plastic, or carbon fiber composite.

6. The forever flyer flag and flagpole as described in claim 1 wherein the flag includes a support arm pocket that is located along a top side of the flag and is located at an end opposite the side of the flag closest to the flagpole; wherein the support arm pocket secures the spring-loaded extension arm therein, and in effect fully extends the top side of the flag.

7. The forever flyer flag and flagpole as described in claim 6 wherein the support arm pocket is attached onto the flag via a fastening means comprising stitching and/or adhesive.

8. The forever flyer flag and flagpole as described in claim 1 wherein the flag tube lift has flag grommets that secure the flag along the side closest the flagpole to the flag tube lift, which in effect fully extends the flag along the side closest the flagpole.

9. The forever flyer flag and flagpole as described in claim 1 wherein the spring-loaded support arm has a spring, a 90-degree bend, and a portion that extends down and attaches onto the flag tube lift.

10. The forever flyer flag and flagpole as described in claim 1 wherein the flagpole is either partially buried into the ground to support the flagpole in a vertical orientation or the flagpole has a stand to support the flagpole in a vertical orientation.

11. A forever flyer flag and flagpole system comprising:

a flagpole on which a flag tube lift that encircles said flagpole, and which raises and lowers thereon via a rope attached to a bottom collar;

wherein the flag tube lift includes a spring-loaded support arm that extends outwardly with respect to said flagpole, and supports a flag in an unfurled condition along a top side of said flag and a side of said flag closest said flagpole;

wherein the bottom collar attaches to a first end of the rope and abuts a bottom surface of the flag tube lift to lift an lower the flag tube lift with respect to the flagpole wherein the rope traverses within the flagpole via a pulley;

wherein the bottom collar and the flag tube lift are of hollowed construction, having an internal diameter greater than the external diameter of the flagpole;

wherein the rope connects to the bottom collar along an inner surface so as not to interfere with the flag tube lift resting atop of the bottom collar;

wherein a cleat enables said rope to be secured to the flagpole so as to hold the flag tube lift at a predetermined elevation;

wherein the flagpole has a top rope exit that limits the height of travel of the flag tube lift;

wherein the flag is fully extended along a top side and along a side closest the flagpole, which in effect provides an unfurled flag;

wherein the flag includes a support arm pocket that is located along a top side of the flag and is located at an end opposite the side of the flag closest to the flagpole; wherein the support arm pocket secures the spring-loaded extension arm therein, and in effect fully extends the top side of the flag; and wherein the flag and the flag tube lift can rotate around the flagpole without respect to elevation upon said flagpole.

12. The forever flyer flag and flagpole as described in claim 11 wherein the pulley attaches to a bottom surface of a cap that rests atop a flagpole extension; wherein the flagpole extension rests atop said flagpole; wherein the flagpole extension forms a space between the cap and the flagpole; and wherein the pulley attaches to the bottom surface of the cap via a securing means comprising a rivet, nail, bolt, or screen.

13. The forever flyer flag and flagpole as described in claim 12 wherein the flagpole, the bottom collar, the flagpole extension, the cap and the flag tube lift are of hollowed construction of a material comprising a metal, plastic, wood, or carbon fiber composite.

14. The forever flyer flag and flagpole as described in claim 11 wherein the support arm pocket is attached onto the flag via a fastening means comprising stitching and/or adhesive.

15. The forever flyer flag and flagpole as described in claim 11 wherein the flag tube lift has flag grommets that secure the flag along the side closest the flagpole to the flag tube lift, which in effect fully extends the flag along the side closest the flagpole.

16. The forever flyer flag and flagpole as described in claim 11 wherein the spring-loaded support arm has a spring, a 90-degree bend, and a portion that extends down and attaches onto the flag tube lift.

17. The forever flyer flag and flagpole as described in claim 11 wherein the flagpole is either partially buried into the ground to support the flagpole in a vertical orientation or the flagpole has a stand to support the flagpole in a vertical orientation.

* * * * *